US008471483B2

(12) United States Patent
Lee et al.

(10) Patent No.: US 8,471,483 B2
(45) Date of Patent: Jun. 25, 2013

(54) MULTI-CHANNEL LED DRIVING SYSTEM

(75) Inventors: Chung-Shu Lee, New Taipei (TW); Jung-Chang Lu, New Taipei (TW); Fa-Ping Wang, New Taipei (TW); Kun-Yu Hsieh, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 261 days.

(21) Appl. No.: 13/090,358

(22) Filed: Apr. 20, 2011

(65) Prior Publication Data

US 2012/0268021 A1 Oct. 25, 2012

(51) Int. Cl.
*H05B 37/00* (2006.01)

(52) U.S. Cl.
USPC ..... 315/192; 315/186; 315/217; 315/307

(58) Field of Classification Search
USPC ..... 315/192, 185 R, 186, 193, 209 R, 315/210, 217, 294, 297, 302, 307
See application file for complete search history.

(56) References Cited

U.S. PATENT DOCUMENTS

| | | | | |
|---|---|---|---|---|
| 2010/0045208 | A1* | 2/2010 | Siessegger | 315/294 |
| 2010/0164403 | A1* | 7/2010 | Liu | 315/297 |
| 2011/0128303 | A1* | 6/2011 | Yonemaru et al. | 345/690 |
| 2011/0309758 | A1* | 12/2011 | Yu et al. | 315/192 |

* cited by examiner

*Primary Examiner* — Daniel D Chang
(74) *Attorney, Agent, or Firm* — Chun-Ming Shih; HDLS IPR Services

(57) ABSTRACT

A multi-channel LED driving system includes a power adapter, a rectifying and filtering unit, a plurality of LED strings, and a plurality of linear regulators, a CC/CV controller, an optically coupled isolator and a PWM controller. The CC/CV controller detects the conducting currents flowing though the LED strings and DC voltage source outputting from the rectifying and filtering unit, and provides voltage compensation of the power adaptor. In addition, the linear regulators slightly modulate the current difference between the LED strings to achieve current-sharing control, thus stabilize the illuminating brightness generating by the LED.

8 Claims, 4 Drawing Sheets

MULTI-CHANNEL LED DRIVING SYSTEM

BACKGROUND OF THE INVENTION

1. Field of the Invention

The present invention relates to a LED driving device, and in particular to a multi-channel LED driving device.

2. Description of Prior Art

Light emitting diodes (LEDs) have high luminous efficiency, long service time, widely operation temperature and environmental mercury-free, making them beyond the incandescent and fluorescent light bulbs, and led lighting field into a new solid-state lighting era.

However, the service time and light illuminating intensity of the LED is affected by its forward-bias and current to temperature characteristics, therefore, using a constant current is an optimal method to drive LED used in the lighting field and that can improve the power efficiency. Also, a multi-channel LED circuit including a plurality of LED strings composed of multiple LEDs electrically connected in parallel must drive the LED strings at the same time. However, due to different internal resistances of the LEDs, the conducting currents provided by a voltage source flowing through the LED strings must be different, and this will result in different illuminating brightness of the LED strings, the efficiency of the multi-channel LED circuit is accordingly reduced.

Therefore, it is desirable to achieve the objective of current-sharing control of the multi-channel LED driving circuit.

SUMMARY OF THE INVENTION

In order to solve the above-mentioned problem, a multi-channel LED driving system is disclosed. The multi-channel LED driving system includes a power adapter, a rectifying and filtering unit, a plurality of LED strings, a plurality of linear regulators, a constant current and constant voltage (CC/CV) controller, an optically coupled isolator and a pulse width modulation (PWM) controller. The rectifying and filtering unit is electrically connected to the power adapter. The LED strings composed of multiple serial LEDs are electrically connected to the rectifying and filtering unit in parallel. Each linear regulator included a switch diode and a MOSFET are electrically connected to corresponding LED string. The CC/CV controller having multiple switch diodes is electrically connected to the linear regulators through the switch diodes. The optically coupled isolator has a light-emitting side and a light-detecting side. The light-emitting side is electrically connected to the CC/CV controller for receiving a conducting current flowing through the CC/CV controller and isolatedly transmitting to the light-emitting side. The PWM controller is electrically connected to the power adapter and the optically coupled isolator for receiving a detecting signal transmitted from the optically coupled isolator, thus controls the power adapter according to the detecting signal.

The CC/CV controller provides voltage compensation of the power adapter by detecting the conducting currents flowing through the LED strings and the voltage outputted from the rectifying the filtering unit, and then modulating the difference between the conducting currents flowing through the LED strings by the linear regulators so as to achieve current-sharing control.

The multi-channel LED driving system according to the present invention detects the conducting current flowing through the LED strings and the outputting voltage of the rectifying and filtering, thus controls the power adaptor to achieve voltage compensation. In addition, the linear regulators slightly modulate the difference between the conducting currents flowing through the LED strings to achieve current sharing control and stabilize the illuminating intensity generating by the LEDs.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

A preferred embodiment of the present invention will be described with reference to the drawings.

Figure 1:
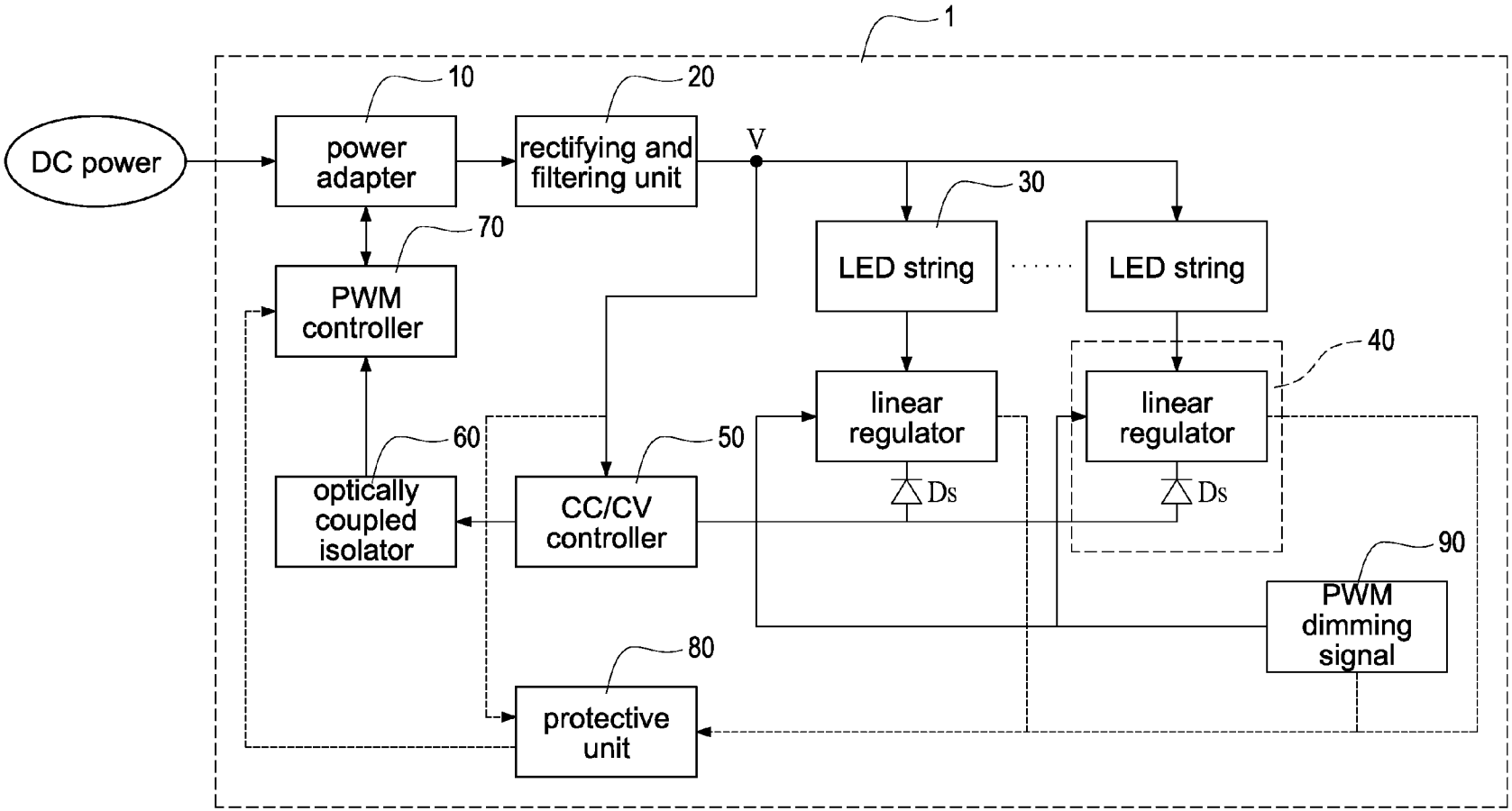
FIG. 1 is a circuit block diagram of a multi-channel LED driving system according to the present invention.

Referenced is made to FIG. 1 which is a circuit block diagram of a multi-channel LED driving system according the present invention. The multi-channel LED driving system electrically connected to an external DC power for powering a plurality of LED strings is applied for backlight field. The multi-channel LED driving system 1 includes a power adapter 10, a rectifying and filtering unit 20, a plurality of LED strings 30, a plurality of linear regulators 40, a constant current/constant voltage (CC/CV) controller 50, an optically coupled isolator 60, a pulse width modulation (PWM) controller 70 and a protective unit 80.

The power adapter 10 is electrically connected to the DC power, and in this embodiment, the power adapter 10 is an isolated DC to DC adapter having a main transformer (not shown). The isolated DC to DC adapter modulates the potential level of the DC power inputted from a primary side of the main transformer and outputs a modulated DC power from a secondary side of the main transformer so as to drive the LED strings 30. The potential level modulation includes boosting voltage or bucking voltage and then stabilizes the modulated DC power as a predetermined voltage. In more particularly, the power adapter 10 is a flyback adapter, a forward adapter, a push-pull adapter, a half-bridge adapter or a full-bridge adapter.

The rectifying and filtering unit 20 is electrically connected to the power adapter 10 to rectify and filter the boosted DC power or the bucked DC power into a stable DC voltage source for driving the LED strings 30.

The LED strings 30 composed of multiple serial LEDs (not shown) are electrically connected to the rectifying and filtering unit 20 in parallel, respectively.

Figure 2:
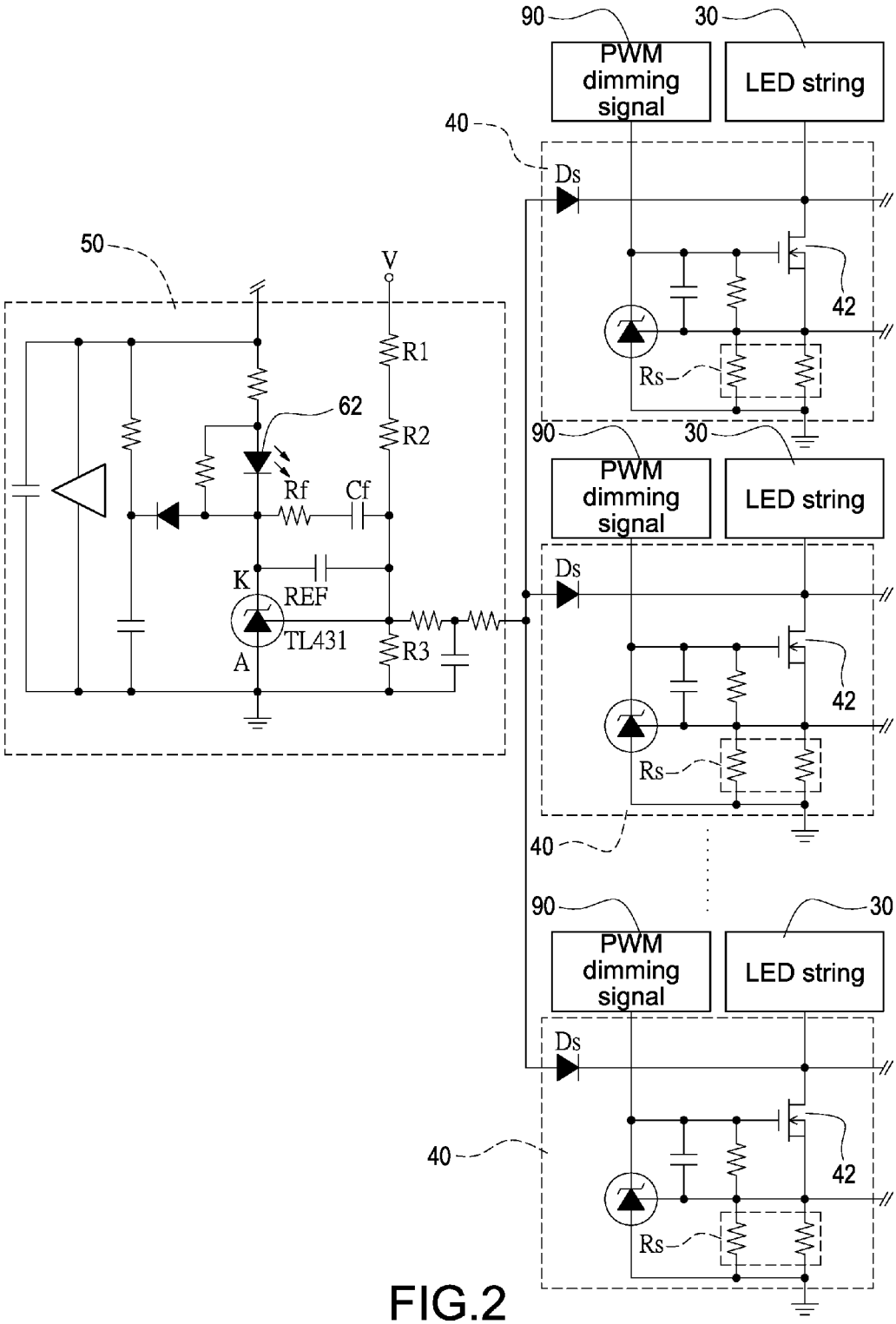
FIG. 2 is a circuit diagram of a CC/CV controller and linear regulators according to the present invention.

Reference is made to FIG. 2 which is circuit diagram of a CC/CV controller and linear regulators according to the present invention. Each of the linear regulators 40 is electrically connected to each of the LED strings 30. The linear regulators 40 slightly modulate the conducting currents flowing through the corresponding LED strings 30 for sharing the conducting currents so as to stabilize illuminating intensity generating by the LED strings 30. Each linear regulator 40 includes a switch diode Ds, a metal-oxide-semiconductor field-effect-transistor (MOSFET) 42 and a detecting resistor Rs. In addition, the conducting currents flowing through the LED strings 30 can be effectively controlled by controlling the conductance channel width of each MOSFET 42.

Referring to FIG. 1 and FIG. 2, the CC/CV controller 50 is electrically connected to the rectifying and filtering unit 20, the LED strings 30 and the linear regulators 40. The CC/CV controller 50 detects the DC voltage source outputted by the rectifying and filtering unit 20 and the conducting currents flowing through the LED strings 30, thus provides voltage compensation of the secondary side of the power adaptor 10 and sharing the conducting currents flowing through the LED strings so as to stabilize illuminating intensity generating by the LED strings 30. The CC/CV controller 50 includes a voltage regulator TL431 and a resistor and capacitor network. A reference terminal REF of the voltage regulator TL431 gets a driving voltage through multiple resistors R1, R2 and R3 of the resistor and capacitor network by voltage division so as to decide to conduct the voltage regulator TL431 or not. In addition, the resistor Rf and capacitor Cf of the resistor and capacitor network decides the frequency response of the CC/CV controller 50.

The optically coupled isolated 60 is electrically connected to the CC/CV controller 50. More particularly, a light-emitting side 62 of the optically coupled isolator 60 is electrically connected to a cathode K of the voltage regulator TL431. When the voltage regulator TL431 is non-conducted, the optically coupled isolator 60 is not driven. Thus the light-emitting side 62 of the optically coupled isolator 60 cannot emit light and a light-detecting side (not shown) of the optically coupled isolator 60 outputs a detecting signal corresponding to zero illuminating intensity. When the voltage regulator TL431 is conducted, a current flows through the light-emitting side 62 and drives the optically coupled isolator 60 so that the light-emitting side 62 emits light. The light-detecting side detects light transmitted from the light-emitting side 62 and outputs a detecting signal corresponding to the illuminating intensity generated by the light-emitting side 62. Also, the driving voltage inputted to the reference terminal REF of the voltage regulator TL431 is progressively increased according to the progressively increase of the DC voltage source outputted from the rectifying and filtering unit. Moreover, the current conducted the voltage regulator TL431 is increased when the driving voltage is increased, therefore the illuminating intensity generating from the light-emitting side 62 of the optically coupled isolator 60 is increased and the detecting signal detecting by the light-detecting side is also increased.

In addition, the linear regulators 40 receive a PWM dimming signal 90 for turning on or turning off the MOSFETs 42 of the linear regulators 40 so as to dim control the LED strings 30.

The PWM controller 70 is electrically connected to the power adapter 10 and light-detecting side of the optically coupled isolator 60. The light-detecting side detects illuminating intensity generating by the light-emitting side and provides a detecting signal corresponding to the illuminating intensity to the PWM controller 70 for modulating duty cycle thereof, namely, the switching time thereof, so as to effectively control the modulated DC power outputted from the secondary side of the main transformer of the power adaptor 10, thus, stabilize the conducting current flowing through the LED strings 30 and the illuminating brightness of the LED strings 30.

Detecting voltage drop are present on the detecting resistors Rs of the linear regulators 40 during the LED strings 30 are operated in feedback controlling mode and the conducting currents flowing through the detecting resistors Rs. When each conducting current flowing through the LED string 30 is smaller than a predetermined conducting current, the voltage drop on the detecting resistor Rs is correspondingly small. The switching diode turns on during the voltage drop between its two terminals is higher than a forward-bias of the switching diode Ds. At the same time, the voltage drop on the reference terminal REF of the voltage regulator TL431 of the CC/CV controller 50 is deceased and if the reference terminal REF of the voltage regulator TL431 is lower than a predetermined reference voltage (2.5V), the voltage regulator TL431 cuts off so the optically coupled isolator 60 is non-conducted, (namely, the light-emitting side 62 of the optically coupled isolator 60 does not emit light). The light-detecting side of the optically coupled isolator 60 receives no illuminating intensity and delivers a detecting signal corresponding to the zero illuminating intensity to the PWM controller 70 so as to increase the modulated DC power outputted from the secondary side of the power adaptor 10, thus the conducting current flowing through the LED strings are increased until the conducting current is equal to or larger than the predetermined current and then the switch diodes Ds are cut off.

The voltage regulator TL431 of the CC/CV controller 50 detects the voltage providing by the power adaptor 10 is excessively large or not through the cathode K by voltage division of the resistors R1, R2 and R3. The voltage regulator TL431 is conducted when the voltage of the cathode K is large than the predetermined voltage, thus the optically coupled isolator 60 is turned on, the light-emitting side 62 emitting light and transmitting light to the light-detecting side. The light-detecting side delivers a detecting signal corresponding to illuminating intensity generated by the light-emitting side 62 to the PWM controller 70 so as to modulate the modulated DC power outputted by the secondary side of the main transformer of the power adaptor and then prevent over voltage damage the LED strings 30.

Because the total forward-bias (Vf) of each LED strings are not the same, the present invention detects the conducting currents flowing through the LED strings 30 and then decides to increase the modulated DC power outputted form the secondary side of the power adaptor 10 or not by the smallest conducting current, thus rendering the conducting currents flowing through the LED strings 30 to be equal to or larger than the predetermined conducting current.

In addition, the MOSFET 42 of each linear regulator 40 regulates the conducting current which is larger than the predetermined conducting current flowing through the LED strings 30. The MOSEFTs 42 regulate the conduction channel by the difference between the predetermine conducting current and the conducting current flowing through the LED strings 30 so as to share the conducting current flowing through the LED strings 30. The voltage drop between the drain and source of each MOSFETs 42 is increased (namely, the conduction channel width is reduced) while the voltage dropping on the correspondingly detecting resistor Rs is large than a predetermine voltage, so as to reduce the voltage dropping on the detecting resistor Rs and then reduce the conducting current flowing through the LED strings 30. Therefore, the conducting currents flowing through the LED strings 30 are all equal to the predetermined conducting current and are the same, thus each of the LED has the same illuminating intensity.

Figure 3:
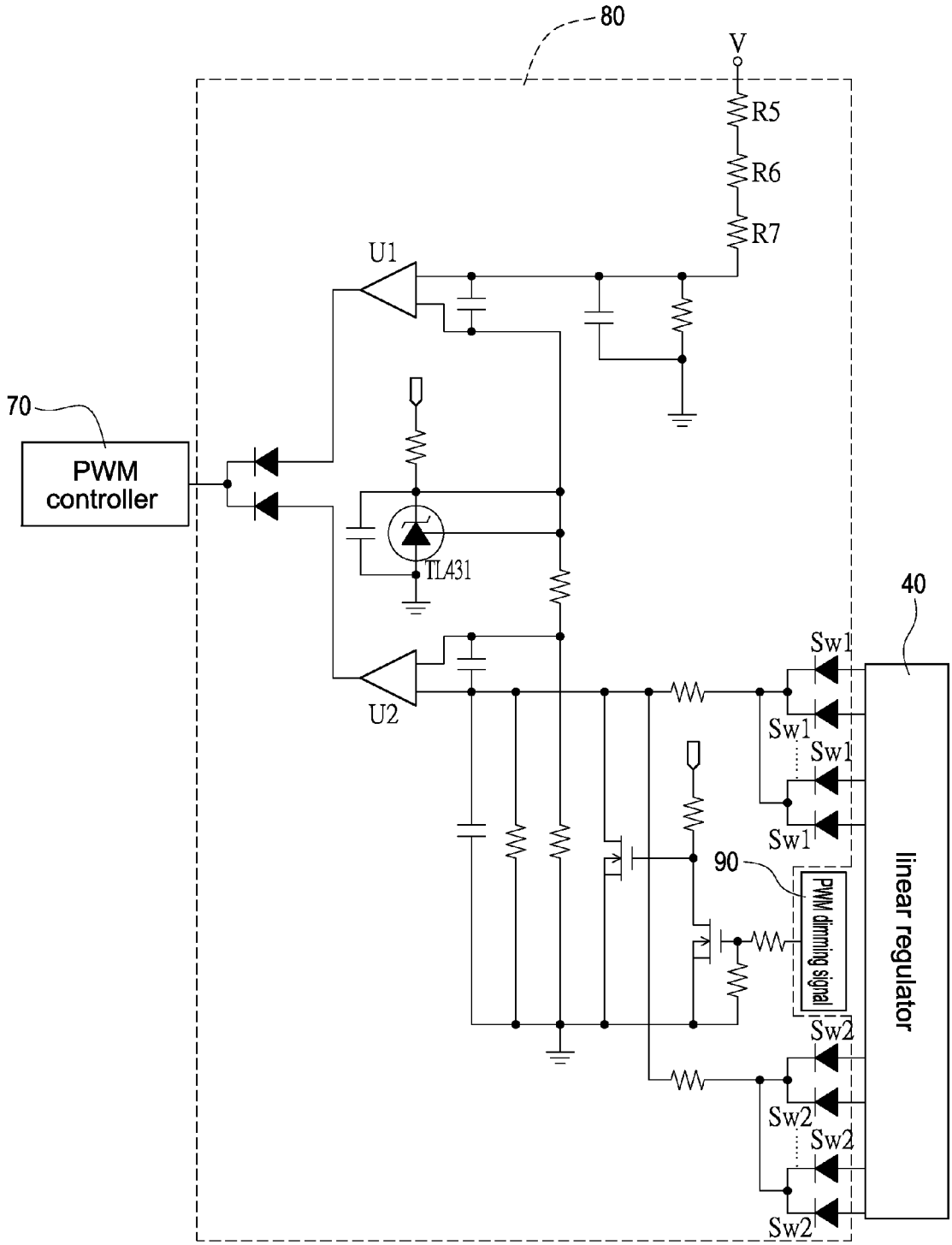
FIG. 3 is a circuit diagram of a protective unit according to the present invention.
Figure 4:
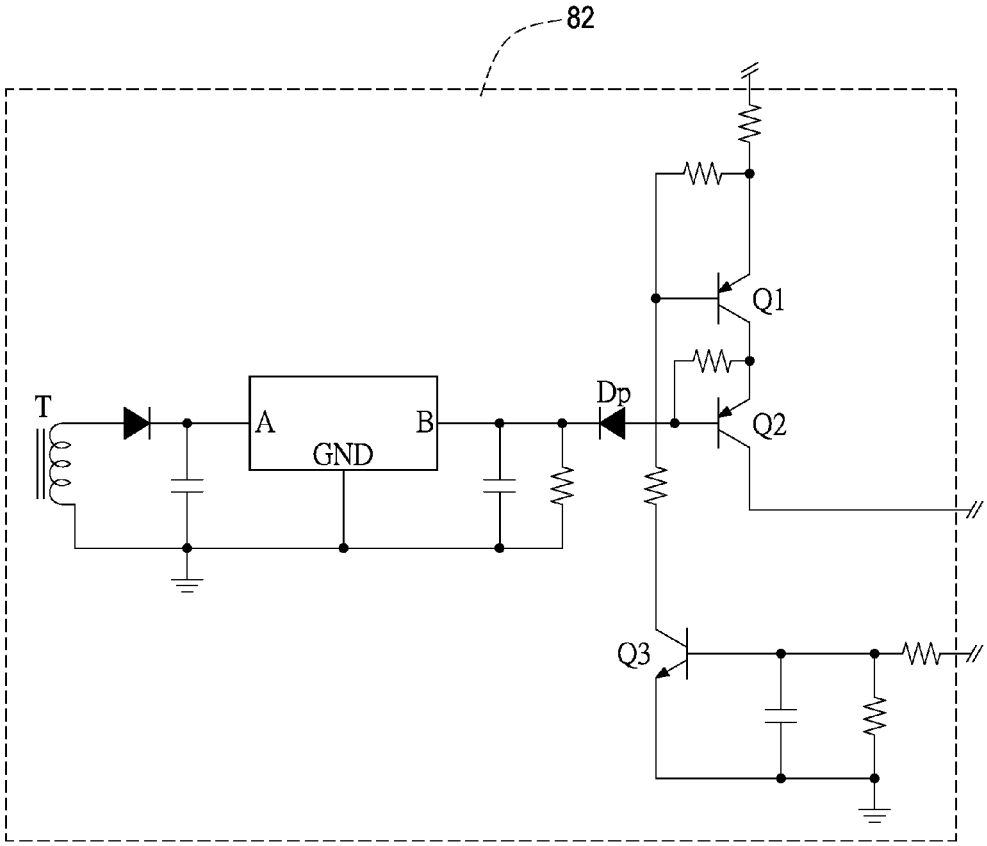
FIG. 4 is a circuit diagram of a short circuit protective circuit according to the present invention.

Reference is made to FIG. 3 which is a circuit diagram of the protective unit of the present invention. The protective unit 80 is electrically connected to the rectifying and filtering unit 20 and the linear regulators 40. The protective unit 80 includes a first operation amplifier U1, a second operation amplifier U2, a voltage regulator TL431, a plurality of first switch units Sw1 and a plurality of second switch units Sw2. A non-inverting input terminal of the first operation amplifier U1 is electrically connected to the outputting end (not shown) of the rectifying and filtering unit 20 through the protective resistors R5, R6 and R7. An inverting input terminal of the first operation amplifier U1 is electrically connected to the voltage regulator TL431 having a reference voltage (2.5V). A non-inverting input terminal of the second operation amplifier U2 is electrically connected to the drains and the sources of MOSFETs of the linear regulators 40 through the first switch units Sw1 and the second switch units Sw2, respectively. An inverting input terminal of the second operation amplifier U2 is electrically connected to the voltage regulator TL431.

The first operation amplifier U1 outputs a protective signal when a division voltage of the protective resistors R5, R6 and R7 is larger than the reference voltage and then turns off the DC power and then inactive the LED strings 30 to achieve over voltage protection (OVP) and LED open circuit protection.

The total forward-bias of the LED strings will decease when each LED of the LED strings 30 is broken down. In order to maintain the conducting current flowing through the LED string 30 having the broken LED, the voltage dropping on the corresponding MOSFET 42 must increase. Moreover, in order to prevent the MOSFET 42 from breaking down, a threshold limit voltage of the MOSFET 42 most be set in advance. The first switch units Sw1 will conduct while the voltage drop between drain and source of corresponding MOSFET 42 is larger than the threshold limit voltage, and the second operation amplifier U2 outputs a protective signal so as to cut off the DC power to achieve LED short circuit protection.

The second switching units Sw2 will conduct while the over detecting voltage dropped on the detect resistor Rs of the linear regulator 40 (which is caused by the conducting current flowing through the corresponding LED strings 30) is excessive. Thus the second operation amplifier U2 outputs a protective signal during each second switch unit Sw2 is conducted so as to cut off the DC power to achieve over current protection (OCP).

The multi-channel LED driving system 1 further includes a short circuit protective (SCP) circuit 82. The short circuit protective circuit 82 including an auxiliary winding T, a protective diode Dp, a first transistor Q1, a second transistor Q2 and a third transistor Q3. The auxiliary winding T is electrically coupled to the primary side of the main transformer of the power adaptor 10. A cathode of the protective diode Dp is electrically connected to the auxiliary winding T and an anode of the protective diode Dp is electrically connected to a base of the first transistor Q1, a base of the second transistor Q2 and a collector of the third transistor Q3, respectively. In this embodiment, the first transistor Q1 and the second transistor Q2 are PNP bipolar junction transistors and the second transistor is an NPN bipolar junction transistor.

In the normal situation, the power adaptor 10 provides a non-zero voltage to the LED strings 30, thus the protective diode Dp cut off and then the first transistor Q1 and the third transistor Q3 are conducted, the second transistor Q2 is cut-off, the modulated DC power outputting by the power adapter 10 directly outputs to the LED strings 30. The protective diode Dp is conducted when a filtering capacitor C of the rectifying and filtering unit 20 is short, so as to conduct the second transistor Q2 to achieve short circuit protection.

In conclusion, the CC/CV controller 50 of the present invention detects the conducting currents flowing through the LED strings 30 and the DC voltage source outputted from the rectifying and the filtering unit 20 so as to achieve voltage compensation of the power adaptor 10. In addition, the linear regulators 40 shares the conducting currents by slightly modulating the difference between conducting current flowing through the LED string 30 so as to stabilize the illuminating intensity of the LEDs.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A multi-channel LED driving system, comprising:

a power adapter;

a rectifying and filtering unit electrically connected to the power adapter;

a plurality of LED strings, composed of multiple serial light emitting diodes, electrically connected to the rectifying and filtering unit in parallel, respectively;

a plurality of linear regulators respectively electrically connected to the LED strings, wherein each linear regulator comprises a switch diode and a MOSFET;

a constant current and constant voltage (CC/CV) controller electrically connected to the linear regulators;

an optically coupled isolator had a light-emitting side and a light-detecting side, the light-emitting side electrically connected to the CC/CV controller, thus receiving a current provide by conduction of the CC/CV controller and isolated transmitting to the light-detecting side;

a pulse width modulation (PWM) controller electrically connected to the power adapter and the optically coupled isolator for receiving a detecting signal transmitted from the optically coupled isolator and then controlling the power adapter according to the detecting signal; and a protective unit electrically connected to the CC/CV controller and the linear regulators, the protective unit comprising:

a voltage regulator;

a first operation amplifier having an inverting input terminal and the inverting input terminal electrically connected to the voltage regulator;

a plurality of protective resistors electrically connected to a non-inverting input terminal of the first operation amplifier and the rectifying and filtering unit;

wherein, the first operation amplifier compares the DC voltage source outputted from the rectifying and filtering unit and the voltage of the voltage regulator to provide over-voltage protection and LED open circuit protection;

whereby the CC/CV controller detects the conducting currents flowing through the LED strings and DC voltage sources outputted from the rectifying and filtering unit to provides voltage compensation of the power adaptor, the linear regulators modulate difference between the conducting currents of the LED strings to achieve current sharing control.

2. The multi-channel LED driving system in claim 1, wherein the protective unit further comprises:

a second operation amplifier electrically connected to the voltage regulator;

a plurality of first switch units electrically connected to the second operation amplifier and drains of the MOSFETs;

a plurality of second switch units electrically connected to the second operation amplifier and sources of the MOSFETs;

wherein, the second operation amplifier compares the voltages of the drains and the voltage of the voltage regulator to provide LED short circuit protection, the second operation amplifier compares the voltages of the sources and the voltage of the voltage regulator to provide overcurrent protection.

3. The multi-channel LED system in claim 1, wherein the protective unit further comprising a short circuit protective circuit, the short circuit protective circuit comprising:

an auxiliary winding electrically coupled to the power adaptor;

a protective diode electrically connected to the auxiliary winding;

a first transistor electrically connected to the protective diode;

a second transistor electrically connected to the protective diode and the first transistor; and a third transistor electrically connected to the protective diode;

whereby, the auxiliary winding detects a modulated DC power outputting from the power adaptor and turns on and turns off the second transistor so as to achieve short circuit protection.

4. The multi-channel LED driving system in claim 3, wherein the first transistor is a PNP bipolar junction transistor and the second transistor is an NPN bipolar junction transistor.

5. The multi-channel LED driving system in claim 1, wherein the power adapter is an isolated DC to DC adaptor.

6. The multi-channel LED driving system in claim 1, wherein the CC/CV controller comprises a voltage regulator and a resistor and capacitor network electrically connected to the voltage regulator.

7. The multi-channel LED driving system in claim 6, wherein the resistor and capacitor network comprises a resistor and a capacitor to decide the frequency response of the CC/CV controller.

8. The multi-channel LED driving system in claim 1, wherein the linear regulator and the CC/CV controller respectively receives an external PWM dimming signal, thus control the voltage that the LED strings output by the dimming signal.

* * * * *